US005537824A

United States Patent [19]

Gustafson et al.

[11] Patent Number: 5,537,824

[45] **Date of Patent: *Jul. 23, 1996**

[54] NO LOSS FUELING SYSTEM FOR NATURAL GAS POWERED VEHICLES

[75] Inventors: Keith W. Gustafson, Waleska; George W. Kalet, Maretta, both of Ga.

[73] Assignee: Minnesota Valley Engineering, New Prauge, Minn.

[ * ] Notice: The term of this patent shall not extend beyond the expiration date of Pat. No. 5,421,160.

[21] Appl. No.: 189,205

[22] Filed: Jan. 31, 1994

Related U.S. Application Data

[63] Continuation-in-part of Ser. No. 36,176, Mar. 23, 1993, Pat. No. 5,421,160.

[51] Int. Cl.[6] ..... F25B 19/00

[52] U.S. Cl. ..... 62/7; 62/50.2; 123/525; 123/527

[58] Field of Search ..... 62/50.2, 7; 123/525, 123/527

[56] References Cited

U.S. PATENT DOCUMENTS 2,986,593 5/1961 Detrick .
3,456,451 7/1969 Roberson Jr. .
4,449,509 5/1984 Young ..... 123/525
5,107,906 4/1992 Swenson et al. ..... 62/50.2
5,121,609 6/1992 Cieslukowski .
5,127,230 7/1992 Neeser .
5,163,409 11/1992 Gustafson et al. .
5,228,295 7/1993 Gustafson .
5,231,838 8/1993 Cieslukowski .
5,315,831 5/1994 Goode et al. .
5,325,894 7/1994 Kooy et al. .

*Primary Examiner*—Ronald C. Capossela
*Attorney, Agent, or Firm*—Rockey, Rifkin and Ryther

[57] ABSTRACT

The fueling station consists of a vacuum insulated storage vessel for storing a large quantity of LNG at low pressure. The LNG is delivered to one of two relatively small volume fuel conditioning tanks where the pressure and temperature of the LNG can be raised or lowered as dictated by the needs of the system. The pressure and temperature in the fuel conditioning tanks are raised by delivering high pressure natural gas vapor thereto from a high pressure bank. The temperature and pressure can be lowered by venting natural gas from the fuel conditioning tanks and/or delivering LNG thereto. The fuel conditioning tanks are connectable to a vehicle's fuel tank via a fill line to deliver natural gas and LNG to the vehicle and to vent natural gas from the vehicle to the fueling station.

24 Claims, 6 Drawing Sheets

NO LOSS FUELING SYSTEM FOR NATURAL GAS POWERED VEHICLES

This application is a continuation-in-part of U.S. application Ser. No. 08/036,176 filed Mar. 23, 1993 now U.S. Pat. No. 5,421,160

BACKGROUND OF THE INVENTION

This invention relates, generally, to liquid natural gas (LNG) delivery systems and, more particularly, to a no loss fueling station particularly suited for use with natural gas powered motor vehicles.

In recent years great efforts have been made to find and develop a cheaper and more reliable domestic energy alternative to foreign fuel oil. One such alternative is natural gas which is domestically available, plentiful, relatively inexpensive and environmentally safe as compared to oil. Because one of the largest uses for fuel oil is as a fuel for motor vehicles, great strides have been made to develop fuel systems for motor vehicles that utilize natural gas.

One possibility is a dual-fuel modified diesel engine that runs on a 60/40 diesel fuel to LNG mixture. While this engine substantially reduces diesel fuel consumption, it requires that the LNG be delivered to the engine at approximately 300 psi, a pressure approximately six times the normal storage pressure for LNG. Other natural gas powered engines require that the LNG be delivered at pressures ranging from less than 50 psi to more than 500 psi. Also, the vehicles being filled can be at a variety of conditions from being full at high pressure to being completely empty at low pressure or any combination thereof. Therefore, an LNG fueling station that can deliver LNG to vehicles having wide variations in fuel tank conditions is desired.

A further complicating factor is that LNG is an extremely volatile substance that is greatly affected by changes in temperature and pressure. As a result, the fueling station must be able to accommodate fluctuations in pressure and temperature and transitions between the liquid and gas states resulting from heat inclusion that inevitably occurs in cryogenic systems. Optimally, the fueling station should be able to meet these conditions without venting LNG to the atmosphere because venting LNG is wasteful and potentially dangerous. One such fueling station is disclosed in U.S. Pat. No. 5,121,609.

Thus, a no loss fueling station that is efficient, safe and can deliver LNG at a range of temperatures, pressures and operating conditions is desired.

SUMMARY OF THE INVENTION

The fueling station of the invention consists of a vacuum insulated storage vessel for storing a large quantity of LNG at low pressure. The LNG is delivered to one of two relatively small volume fuel conditioning tanks where the pressure and temperature of the LNG can be raised or lowered as dictated by the needs of the system. The pressure and temperature in the fuel conditioning tanks are raised by delivering high pressure natural gas vapor thereto from a high pressure bank. The temperature and pressure can be lowered by venting natural gas from the fuel conditioning tank and/or delivering LNG thereto. The fuel conditioning tanks are releasably connectable to a vehicle's fuel tank via a fill line to deliver natural gas and LNG to the vehicle and to vent natural gas from the vehicle to the fueling station.

DETAILED DESCRIPTION OF THE INVENTION

Figure 1:
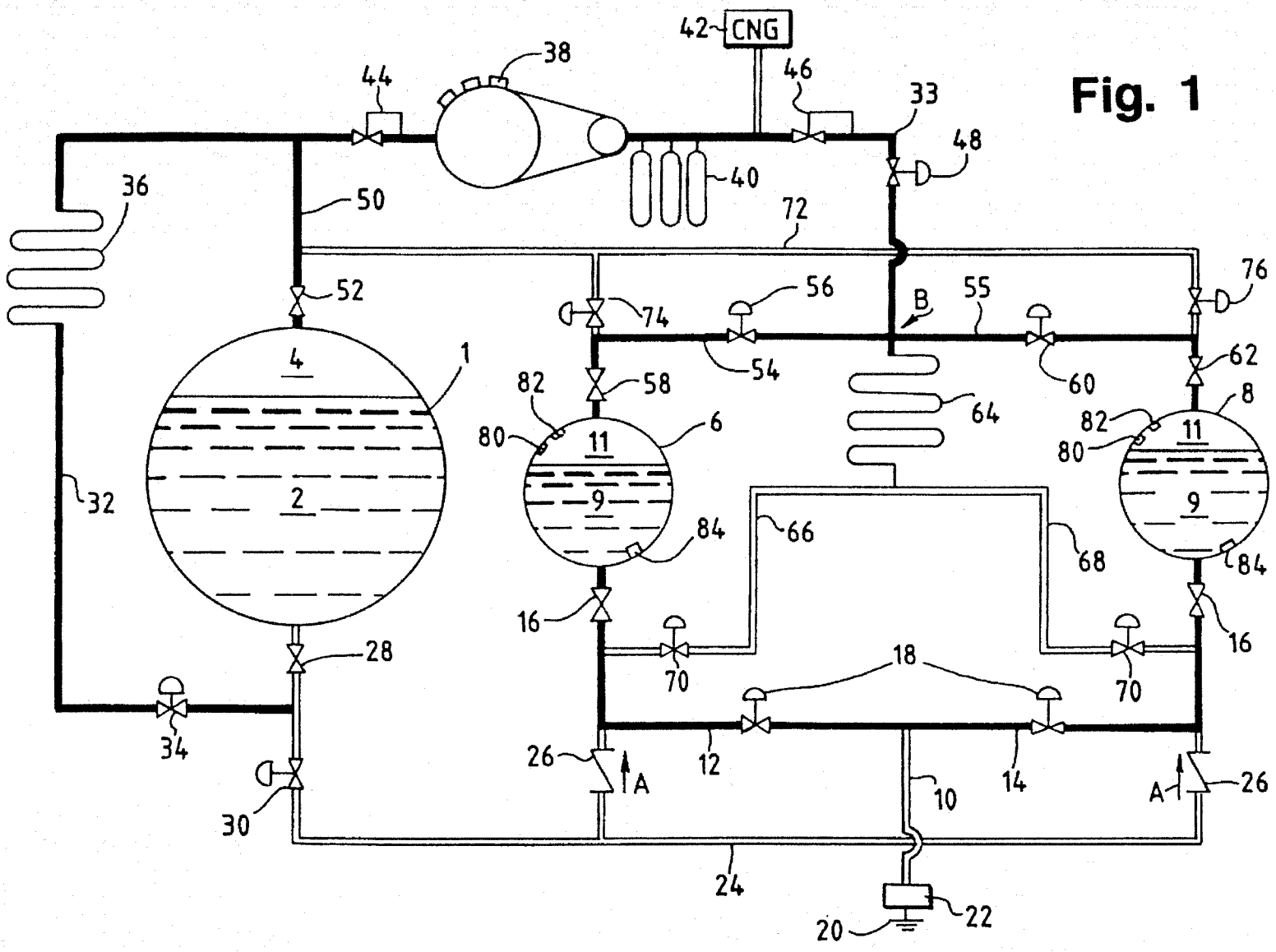
FIG. 1 shows a schematic view of the fueling station of the invention.

Referring more particularly to FIG. 1, the fueling station of the invention consists of a storage vessel 1 holding a relatively large supply of LNG 2. Storage vessel 1 is preferably a double-walled, vacuum insulated tank. Although vessel 1 is insulated, some heat transfer will occur between the LNG 2 and the ambient environment. As a result, some of the LNG in vessel 1 will vaporize to create a gas head 4 in vessel 1 which pressurizes the LNG in vessel 1 to a relatively low pressure, for example 50 psi.

The system further includes a pair of relatively small volume pressure building tanks 6 and 8. Each of the fuel conditioning tanks 6 and 8 retain a quantity of LNG 9 and a natural gas vapor head 11. Fuel conditioning tanks 6 and 8 are connected to delivery line 10 via LNG use lines 12 and 14, respectively. LNG use lines 12 and 14 communicate with the LNG in their respective tanks and each include a manual shut off valve 16 and an automatic valve 18. Delivery line 10 is provided with a coupling 20 for releasably engaging a mating coupling associated with the vehicle's fuel system. A meter 22 can be provided in line 10 to measure the quantity of LNG delivered to the vehicle.

A low pressure LNG fill line 24 connects the LNG 2 of vessel 1 with the fuel conditioning tanks 6 and 8 by tapping into LNG use lines 12 and 14 as shown in the drawing. The fill line 24 taps into lines 12 and 14 between valves 16 and 18 such that when valves 16 are open and valves 18 are closed the LNG will flow from vessel 1 to tanks 6 and 8 under the force of gravity. Note, valves 58, 74 and 52 are open to allow the vapor to return to tank 1.

Line 24 is provided with check valves 26 that allow fluid to flow only in the direction of arrows A from the vessel 1 to tanks 6 and 8. Line 24 is also provided with manual shut off valve 28 and automatic valve 30.

A pressure building line 32 extends from LNG fill line 24 to compressor 38 and line 33 extends from compressor 38 to point B where the fueling module begins. Pressure building line 32 taps into line 24 between valves 28 and 30 such that when valve 28 and valve 34 in line 32 are open, LNG will flow from vessel 1 through line 32.

Line 32 further includes a vaporizer 36 for heating the LNG delivered from vessel 1 to convert the LNG into natural gas vapor. Compressor 38 is located downstream of vaporizer 36 to compress the vaporized natural gas and thereby build the pressure in the system. A bank of high pressure, small volume storage tanks 40 is provided to store the compressed natural gas until it is needed. A compressed natural gas (CNG) fill port 42 may be communicated with line 33 to deliver CNG from the system if desired. The compressor 38 can also be used to reduce the pressure in tank 1 by removing the vapor build up in head 4 and compressing it into tanks 40 thereby to avoid venting the fuel to the atmosphere.

Pressure regulators 44 and 46 are located in lines 32 and 33, respectively, to regulate the flow of natural gas through the pressure building mechanism. The inlet regulator 44 controls the inlet pressure of the natural gas vapor to the compressor and the outlet regulator 46 steps the pressure in the high pressure bank 40 down to a pressure that is usable by the system. For example, the compressed natural gas stored in bank 40 can be at 4000 psi while the pressure of the gas leaving outlet regulator 46 may be at 300–400 psi. An automatic valve 48 is provided to control the flow of compressed natural gas into the system.

In certain circumstances, for example when the pressure in vessel 1 exceeds a predetermined value, it may be desirable to deliver the natural gas to the pressure building line from the vapor head 4 of vessel 1. Accordingly, a tap line 50 communicates the vapor head 4 of vessel 1 with compressor 38 via pressure building line 32. A valve 52 controls the flow of natural gas from vessel 1. Because the natural gas delivered from head 4 is already vaporized, the natural gas is not passed through vaporizer 36 although it is warmed as it passes through lines 32 and 50 before reaching pump 38.

The line 33 is connected to a fueling module associated with each of pressure building tanks 6 and 8. Specifically, pressurizing lines 54 and 55 connect line 33 with tanks 6 and 8, respectively. Lines 54 includes automatic valve 56 and manual shut off valve 58 and line 55 includes automatic valve 60 and manual shut off valve 62. When either valves 56 and 58 or 60 and 62 are open and valve 48 is open, high pressure natural gas will be delivered from high pressure bank 40 to the vapor head 11 in tanks 6 and 8, respectively, to a) increase the pressure in those tanks; and b) provide subcool to the product in tanks 6 and 8 to allow fast efficient single hose fill. The pressure build up in tanks 6 and 8 is used to drive the LNG from those tanks into the use device.

A coil 64 connects line 33 to saturation lines 66 and 68 which are connected to the LNG supply 9 of tanks 6 and 8, respectively. Specifically, lines 66 and 68 tap into lines 12 and 14 between valves 16 and 18 and include automatic valves 70 for controlling the flow of natural gas vapor. When valves 48, 70 and 16 are opened, high pressure natural gas will be delivered from the line 33 to the LNG of either tank 6 or 8. The high pressure gas will bubble through the LNG in tanks 6 and 8 to saturate the LNG and increase its temperature.

Finally, a vent line 72 is connected between pressurizing lines 54 and 55 and tap line 50. Vent line 72 includes automatic valves 74 and 76 for controlling the flow of gas from tanks 6 and 8, respectively, back to vessel 1. Gas is delivered from tanks 6 and 8 to vessel 1 to raise the pressure in vessel 1 and/or to lower the pressure and temperature in tanks 6 and 8.

OPERATION OF THE SYSTEM

It should be noted that the manual shut off valves remain open during normal operation of the system and are provided to allow the system operator to isolate various components of the system if necessary for special purposes. For purposes of explanation, assume that storage vessel 1 is full of LNG at relatively low pressure and temperature and that fuel conditioning tanks 6 and 8 are empty and that the manual shut off valves are open. To fill the pressure building tanks 6 and 8, the valves are arranged as follows:

| Valve | Status |
|---|---|
| 30 | Open |
| 74 | Open |
| 76 | Open |
| 18 | Closed |
| 34 | Closed |
| 48 | Closed |
| 56 | Closed |
| 60 | Closed |
| 70 | Closed |

In this condition, LNG is free to flow by gravity from storage vessel 1 into fuel conditioning tanks 6 and 8 via lines 24, 12 and 14. Any gas in tanks 6 and 8 will be vented back to storage vessel 1 via lines 72 and 50. The delivery of LNG will continue until the LNG in tanks 6 and 8 reach the level sensors 80. The sensors send a signal to automatically close valves 30, 74 and 76.

Valve 34 can be opened before, after or during the fill operation to allow LNG to enter pressure building line 32. The LNG will be vaporized at coil 36 and delivered to tank 1 and high pressure bank 40 by compressor 38. Specifically, when pressure sensor 45 detects a drop in pressure in bank 40 the compressor 38 will be turned on. When the pressure in tank 1 reaches a predetermined value, pressure sensor 45 will turn the compressor off. The compressed natural gas will be stored in bank 40 for future use.

To saturate the LNG that has been delivered to fuel conditioning tanks 6 and 8, the status of the valves is as follows:

| Valve | Status |
|---|---|
| 48 | Open |
| 70 | Open |
| 18 | Closed |
| 30 | Closed |
| 56 | Closed |
| 60 | Closed |
| 74 | Closed |
| 76 | Closed |

When the valves are so configured, high pressure natural gas vapor will be delivered from bank 40 to coil 64 via line 33. The natural gas vapor will be delivered from vaporizer coil 64 to tanks 6 and 8 via lines 66 and 68, respectively. The relatively warm, high pressure gas will bubble through the LNG in tanks 6 and 8 to raise the pressure and temperature of the LNG and saturate it at a given pressure. A pressure sensor 82 in tanks 6 and 8 will terminate the saturation process by closing valves 48 and 70 when it senses the predetermined saturation pressure in tanks 6 and 8. The LNG is saturated to prevent the pressure head from collapsing after the LNG is delivered to the use device. Note that saturation of the LNG may not be necessary for all delivery operations and the need for saturating the LNG will depend on the demands of the use device.

In addition to saturating the LNG in tanks 6 and 8 it is also necessary to pressurize the LNG in these tanks to bring the pressure in these tanks up to the pressure required to drive the LNG from these tanks into the use device. To pressurize the tanks, the status of the valves is as follows:

| Valve | Status |
|---|---|
| 48 | Open |
| 56 | Open |
| 60 | Open |
| 18 | Closed |
| 30 | Closed |
| 70 | Closed |
| 74 | Closed |
| 76 | Closed |

With the valves so arranged the high pressure gas from pressure building line 32 will be delivered to the fuel conditioning tanks 6 and 8 via lines 54 and 55. The pressure in the tanks will increase until a timing circuit closes the valves and terminates the flow of gas or until a separate pressure sensor determines that the tanks have reached the desired pressure at which time the delivery of high pressure gas will be terminated. The addition of high pressure gas also "subcools" the liquid in tanks 6 and 8 by increasing the pressure on the liquid thereby raising the temperature at which the liquid vaporizes. The subcooled liquid allows fast efficient, single line fill by preventing the LNG from flashing to gas as it is delivered.

Once the tanks 6 and 8 are filled, saturated and pressurized, the system can deliver LNG to the vehicle. It should be noted that LNG will be delivered first from one of tanks 6 or 8 until that tank is empty. Then the system will deliver LNG from the other tank while the first tank is refilled, saturated and pressurized. In this manner, the system can deliver LNG uninterrupted by refilling one tank as the other tank delivers LNG.

To deliver the LNG the status of the valves are as follows:

| Valve | Status |
|---|---|
| 18 | Open |
| 48 | Open or Closed |
| 56 | Open or Closed |
| 60 | Open or Closed |
| 30 | Closed |
| 70 | Closed |
| 74 | Closed |
| 76 | Closed |

Under these circumstances, LNG is delivered from the tanks 6 and 8 (note only one of the valves 18 will be opened at a time) via lines 12, 14 and 10. Each of tanks 6 and 8 include a low liquid level sensor 84 that senses when the level of LNG in the tank reaches a predetermined minimum. The sensor develops a signal to thereby switch delivery from the empty tank to the full tank and begin the refilling operation of the empty tank. The valves 48, 56 and 60 are either opened or closed depending on whether the volume of fuel in tanks 6 and 8 is sufficient to complete the fill.

In addition to delivering LNG to the vehicle's fuel tank, the fueling station of the invention can also deliver high pressure gas from the CNG port 42. The system can also vent excess gas from the vehicle's fuel tank by opening valves 18, 74 and 76 and allowing the high pressure gas to vent back to vessel 1 or the gas could vent through a check valve on the fueling hose, if desired.

Figure 2:
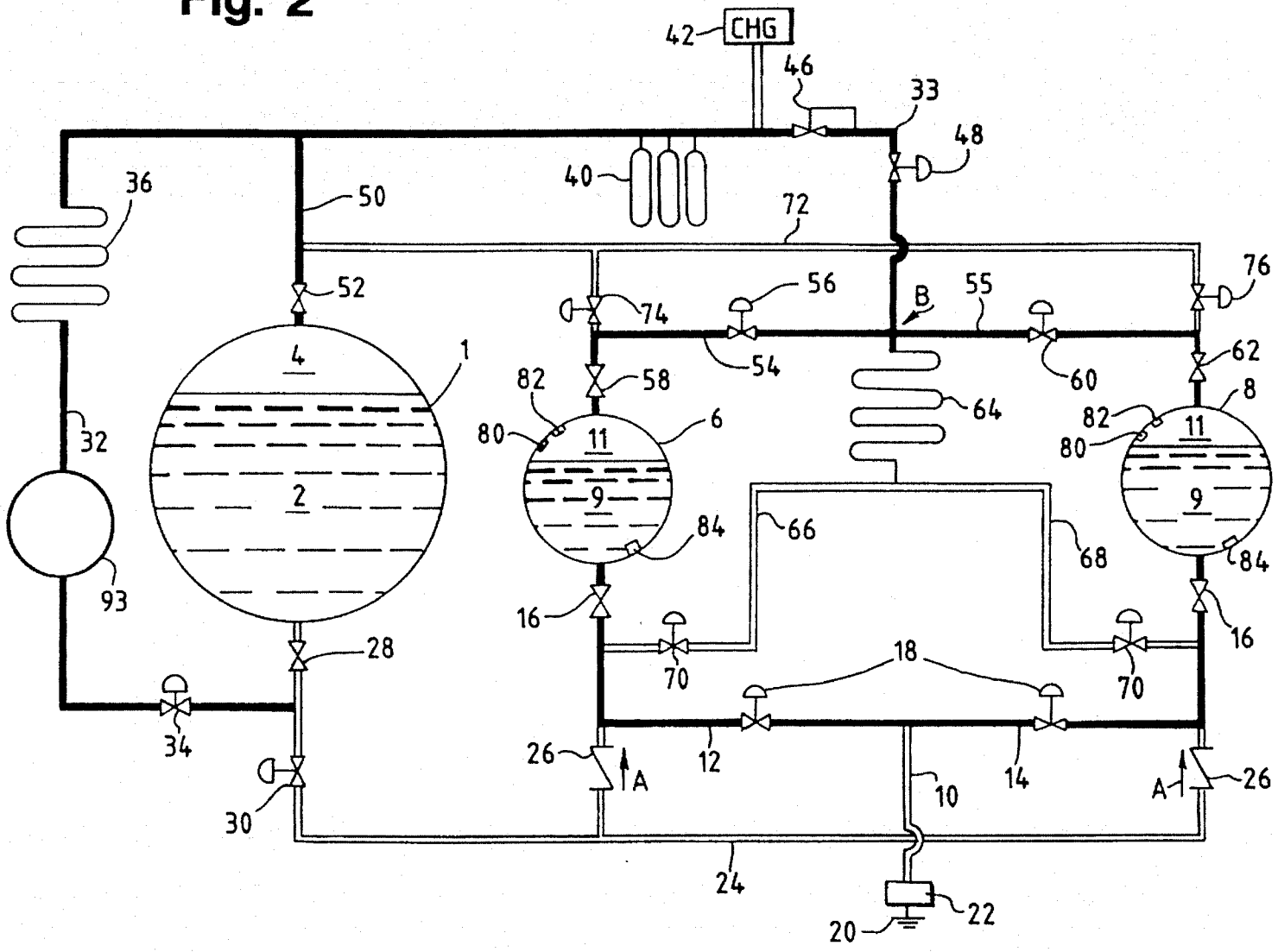
FIG. 2 shows a schematic view of an alternate embodiment of the fueling station of the invention.

An alternate embodiment of the fueling station of the invention is shown in FIG. 2 where like reference numerals are used in FIG. 2 to identify the identical components described with reference to FIG. 1. The fueling station of FIG. 2 is identical to that of FIG. 1 except that a liquid pump 93 is located upstream of vaporizer 36 to deliver compressed liquid natural gas to the vaporizer 36. The vaporized LNG is stored as compressed natural gas in storage bank 40 and is used to pressurize and saturate the LNG in tanks 6 and 8 as previously described. The regulator 44 shown in the embodiment of FIG. 1 is eliminated in the embodiment of FIG. 2 where the liquid pump 93 is used.

Figure 3:
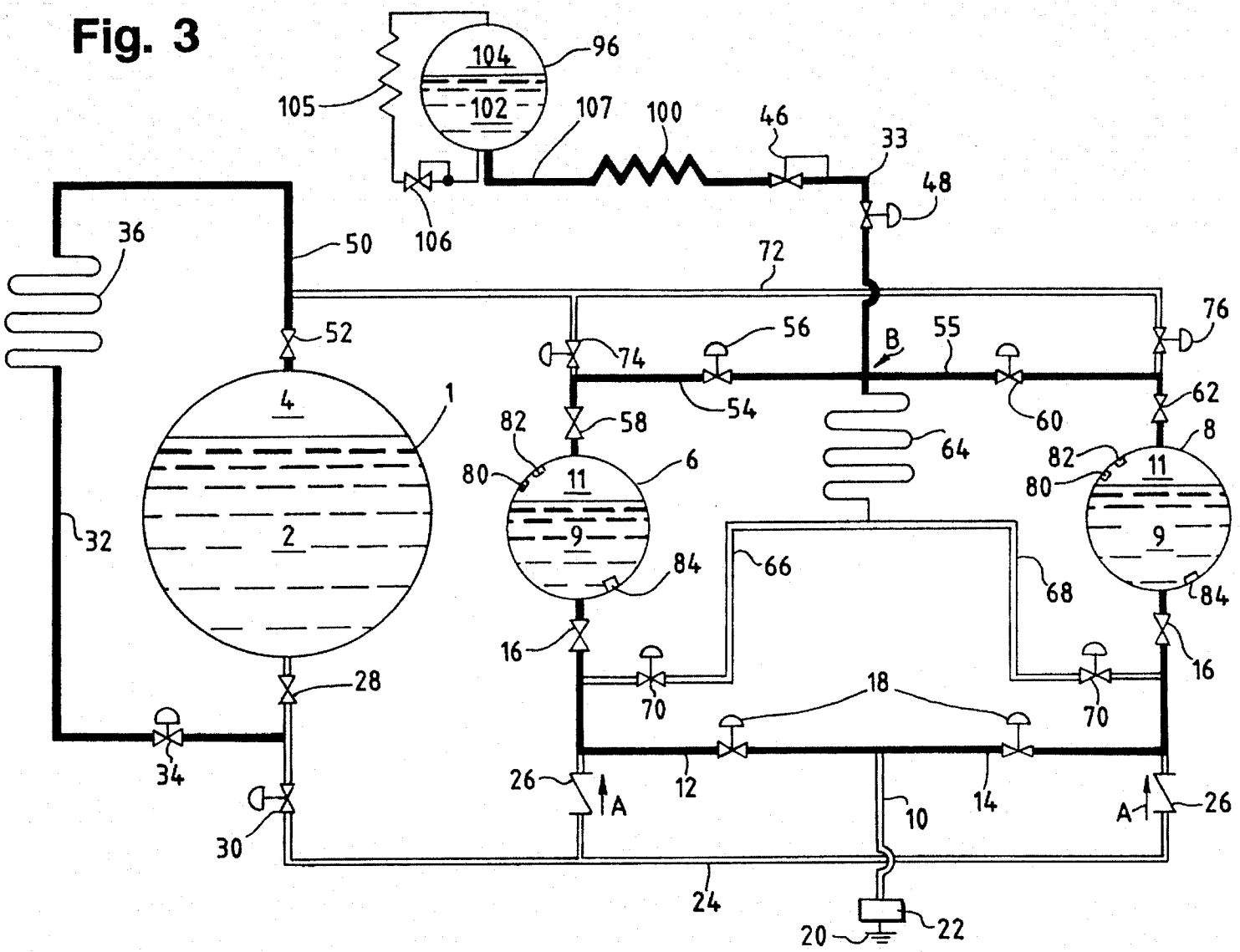
FIG. 3 shows a schematic view of another alternate embodiment of the fueling station of the invention.

Another alternate embodiment of the fueling station of the invention is shown in FIG. 3 where like numerals are used in FIG. 3, to identify the identical components described with reference to FIG. 1. The fueling station of FIG. 3 is the same as that of FIG. 1 except for the source of compressed natural gas. Specifically, compressor 38, regulator 44, CNG storage bank 40 and CNG port 42 of the FIG. 1 embodiment are replaced by a separate LNG storage tank 96, pressure building line 98 and vaporizer 100.

Specifically, storage tank 96 holds a quantity of LNG 102 and a vapor pressure head 104 at a pressure suitable to drive LNG from tank 96. A pressure building line including vaporizer 105 and regulator 106 removes LNG from tank 96, vaporizes it and returns it to head 104 to maintain the desired pressure in tank 96. The LNG delivered from tank 96 via line 107 passes through vaporizer 100 where it is vaporized and is delivered to line 33 at high pressure to saturate and pressurize the LNG in tanks 6 and 8 as previously described.

Pressure building line 32 is connected only to tank 1 via line 50 such that line 32 is used only to build the pressure in tank 1 to enable LNG to be forced therefrom and does not deliver LNG to the source of CNG as was the case in the embodiment of FIG. 1. Thus, the LNG in tank 1 is used only to fill tanks 6 and 8 and is not used to pressurize or saturate the LNG in these tanks, the compressed natural gas used to pressure and saturate tanks 6 and 8 coming from storage tank 96.

The delivery system of the invention can effectively accommodate any filling situation that might be encountered at a vehicle fueling station. The delivery system can control the LNG delivery temperature and pressure and can vent or pressurize the vehicle's fuel tank through one connection.

The following are six principal vehicle tank conditions that may be encountered at the LNG fueling station:

1. The vehicle LNG system is warm with no LNG on board.
2. The vehicle LNG system is nearly empty; the remaining LNG is at high pressure/temperature conditions, near venting.
3. The vehicle LNG system is nearly empty; the remaining LNG is at low pressure/temperature conditions, near or below minimum operating conditions.
4. The vehicle LNG system is partly full; the LNG is at high pressure/temperature conditions, near venting.
5. The vehicle LNG system is partly full; the LNG is at low pressure/temperature conditions, near or below minimum operating conditions.
6. The vehicle LNG system is full; the LNG is at high pressure/temperature conditions, near venting.

While some of these conditions will be unusual, it is necessary that the fueling station be able to accommodate all of them. The fueling station can accommodate each of these situations because it can: 1) deliver vaporized natural gas to pressurize the vehicle tank and raise temperature therein, 2) it can deliver LNG to lower the temperature and pressure in the vehicle tank, or 3) it can vent natural gas from the vehicle tank back to the fill station system to lower the pressure and temperature therein.

As will be appreciated, the valves that control the flow of LNG and CNG through the system can be manually or automatically operated. In the preferred embodiment microprocessor controlled automatic valves are used.

Figure 4:
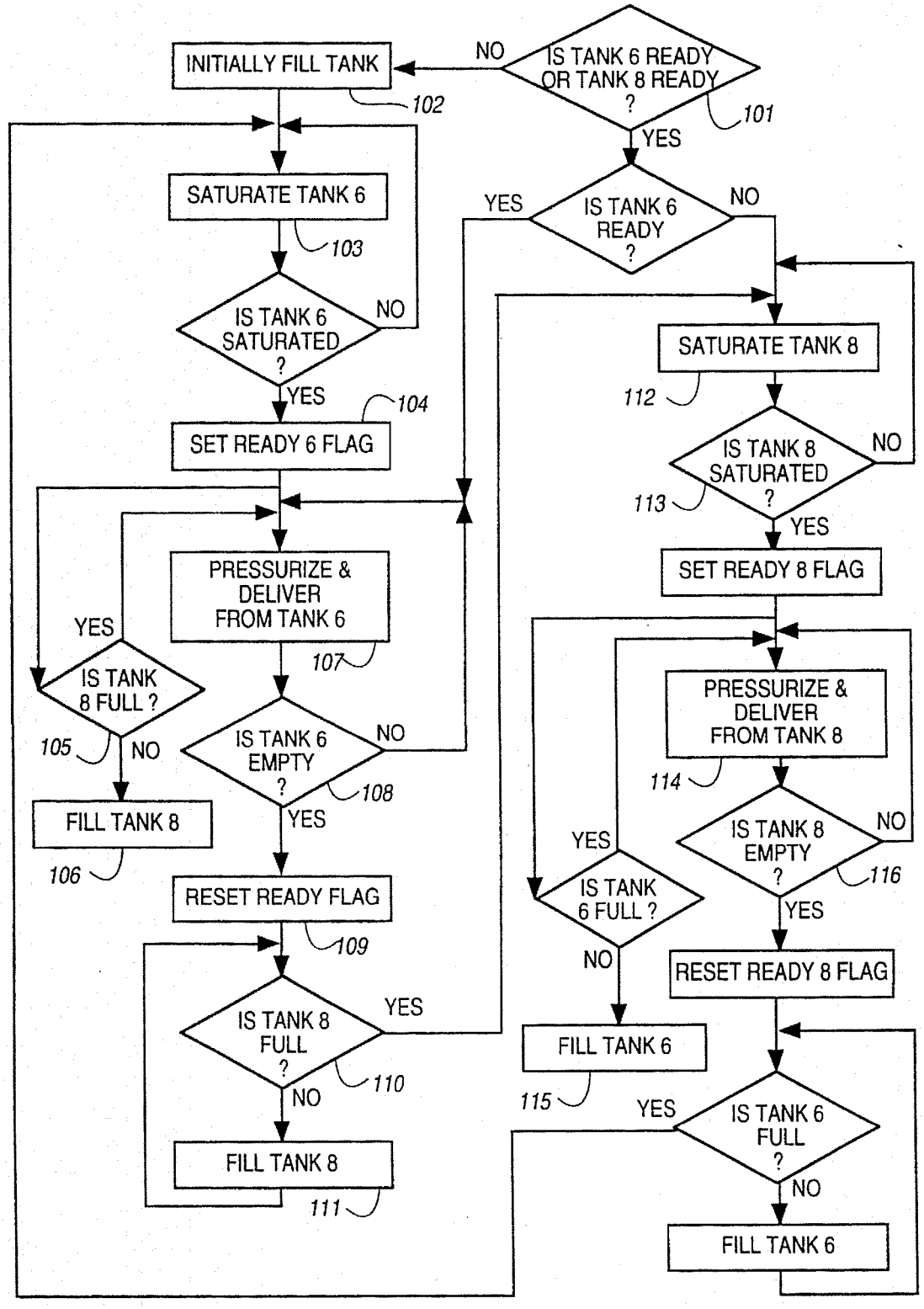
FIGS. 4, 5 and 6 are flow diagrams illustrating the microprocessor control for the fueling station of the invention.

Referring more particularly to FIG. 4, a flow chart illustrates the microprocessor program steps for controlling the filling and saturation of the tanks. Initially, the microprocessor determines, via the sensors in tanks 6 and 8, if either or both of the tanks are full and saturated (101). If the tanks are full and saturated, delivery of LNG from the tanks can be made immediately. For purposes of illustration, it is assumed that tanks 6 and 8 are both empty. Thus, the program proceeds through the series of steps listed on the left side of FIG. 3.

Tank 6 is first filled with LNG (102) and is saturated (103). The saturation process proceeds until the LNG is saturated at which time a "ready flag" is set indicating that tank 6 is ready to deliver LNG (104). Once tank 6 is ready, the microprocessor determines if tank 8 is full (105). If tank 8 is not full, it is filled from tank 1 (106). While tank 8 is being filled, delivery can occur from tank 6 (107). Delivery will continue until tank 6 is empty (108) at which time the "ready flag" is reset (109).

Once tank 6 is empty the microprocessor determines if tank 8 is full (110) and, if it is not full, fills it from tank 1 (111). Once tank 8 is filled, it is saturated (112) and the "ready flag" is set (113). Delivery can thus be made from tank 8 (114). While delivery is made from tank 8, tank 6 is filled (115).

Delivery continues until tank 8 is empty (116) at which time the ready flag for tank 8 is reset (117) and the filling and saturation process for tank 6 (103) is begun. The microprocessor repeats this process to continuously fill, saturate and deliver LNG alternately from tanks 6 and 8.

The microprocessor steps for saturating tank 6 (step 103 described with reference to FIG. 3) are illustrated in FIG. 4, it being understood that tank 8 is saturated in a like manner. First, the line pressure in lines 66 and 68 is released back into tank 6 (201) by opening valve 70 for a predetermined time period, i.e., five seconds (202). Once the line pressure is released back to tank 8, the microprocessor determines if it is operating in "economy mode" (203). In "economy mode" the microprocessor uses the pressure in the system to saturate the LNG. In the non-"economy mode" the microprocessor saturates the LNG directly from the CNG supply.

Operation of the "economy mode" will be described first. Pressurized gas from the top of tank 8 is flowed into the bottom of tank 6 by opening valves 60 and 70 (204) for a predetermined period of time, i.e., 165 second time delay (205). After the delay period is terminated, the microprocessor determines if the LNG in tank 6 is saturated via sensor 82 (206). If the LNG in tank 6 is saturated, the pressure in tanks 6 and 8 is equalized by opening valves 56 and 60 to allow gas to flow from tank 8 to tank 6 (207). The flow of gas is terminated after a ten second delay (208) at which time saturation is complete (209) and the ready flag is set (210).

If tank 6 is not saturated after step 206, valve 60 is closed and the LNG in tank 6 is saturated by LNG delivered from CNG storage bank 40 supply by opening valves 48 and 70 (211). The delivery of CNG continues until the sensor 81 indicates that tank 6 is saturated (212) at which time saturation is complete (213) and the ready flag is set (210).

In the non-economy mode, tank 6 is saturated by transferring gas from CNG storage bank 40 through valve 70 into tank 6 (211). Thus, in the non-economy mode, the pressurized gas existing in the system is not utilized and more CNG from bank 40 must be used.

Figure 5:
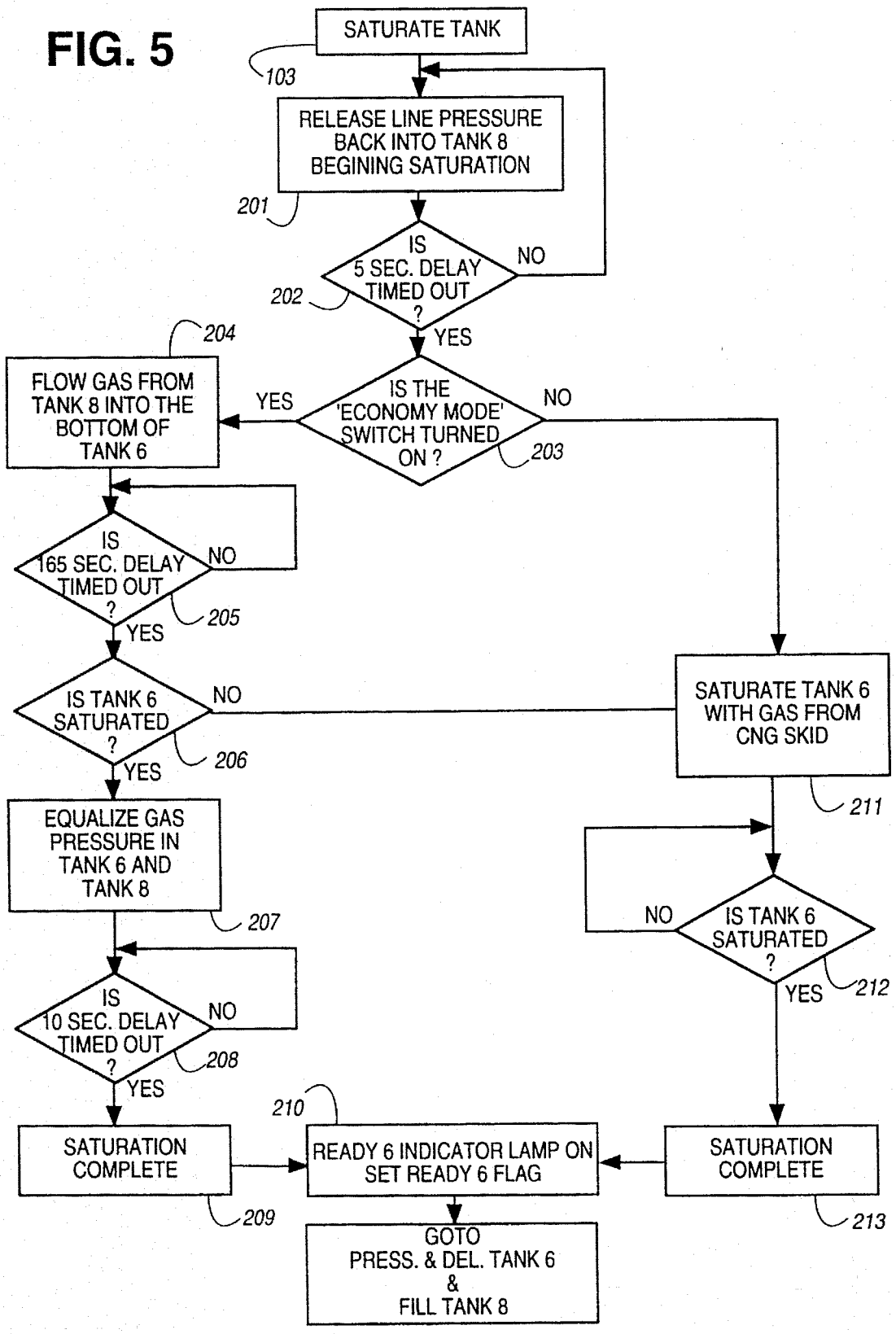

Referring more particularly to FIG. 5, the microprocessor steps for pressurizing and delivering LNG from the saturated tank 6 is described (step 107 of FIG. 4). The microprocessor first determines if there is a demand for LNG (301). If there is a demand, tank 6 is pressurized by delivering high pressure gas to the top of the tank (over the saturated LNG) (302). The high pressure gas is delivered from CNG bank 40 via line 54 by opening valves 48 and 56. The pressure in tank 6 is increased until it reaches a predetermined level sufficient to drive the LNG from tank 6 to the vehicle tank (303). LNG is delivered from tank 6 (304) through valve 18 until sensor 84 determines that the liquid level is low (305). The ready flag is reset (306) and delivery is made from tank 8. Tank 6 is refilled and resaturated as described above.

The operation of the system will now be summarized. LNG will be stored in tank 1 until vehicle fueling. Vapor in tank 1 is collected and compressed either by the compressor 38 or a pump and is stored in the bank 40. Prior to a vehicle arriving for filling, LNG will be delivered from tank 1 to tanks 6 and 8 by gravity fill. At this point tanks 6 and 8 are filled with LNG at the same pressure as the pressure in tank 1.

The saturation pressure in the tanks 6 and 8 is then built as previously described by delivering warm gas to the bottom of the tanks where it will bubble up through the LNG and transfer heat to the LNG as it rises. Upon completion of the saturation process, the liquid and vapor in tanks 6 and 8 must be in equilibrium above the minimum operating pressure of the fuel tank on-board the vehicle being filled.

If the liquid and vapor in tanks 6 and 8 were not at equilibrium at least at the vehicle's minimum operating pressure, the pressure in the vehicle tank would collapse once the sloshing liquid in the fuel tank cooled and recondensed the vapor inside. However, if the liquid is at equilibrium at or above the vehicle's operating pressure, no amount of heat transfer from the sloshing liquid will collapse the tank pressure below the minimum operating levels.

Figure 6:
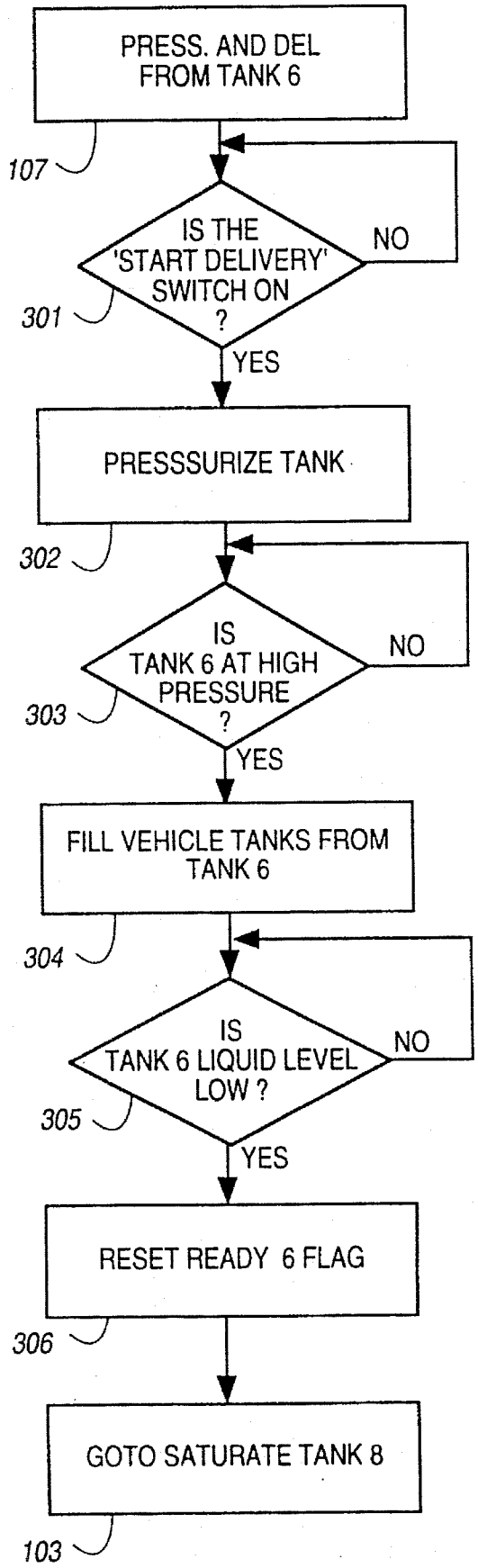

The flow diagrams of FIGS. 4, 5 and 6 and the foregoing description was made with specific reference to the embodiment of FIG. 1. It will be appreciated that the embodiments of FIGS. 2 and 3 operate in a similar manner with the primary distinction being the source of CNG. The operating sequences described in FIGS. 4, 5 and 6 are useful to explain how operation of the system can be microprocessor controlled; however, operating sequences other than those specifically described can be used to control the system.

While the fueling station of the invention has been described with particular reference to LNG delivery systems, it will be appreciated that it could also be used with other cryogens such as liquid hydrogen. Other modifications and changes to the system will be apparent without departing from the invention. It is to be understood that the foregoing description and drawings are offered merely by way of example and that the invention is to be limited only as set forth in the appended claims.

What is claimed is:

1. A no loss fueling station for delivery of liquid natural gas (LNG) to a motor vehicle having a tank mounted thereon, comprising:

a) at least one fuel conditioning tank;

b) means for supplying a quantity of LNG to said at least one fuel conditioning tank;

c) means for pressurizing the LNG in the at least one fuel conditioning tank including a compressor and CNG storage bank for creating and storing compressed natural gas and delivering the compressed natural gas to the at least one fuel conditioning tank to obtain a desired minimum pressure thereby to subcool the LNG for efficient delivery to the vehicle mounted tank; and d) means for delivering LNG from the at least one fuel conditioning tank to the vehicle mounted tank.

2. The fueling station according to claim 1, further including means for saturating the LNG in the fuel conditioning tank to prevent collapse of the pressure head in the vehicle mounted tank when the LNG is delivered thereto.

3. The fueling station according to claim 2, wherein the means for pressurizing includes means for delivering the high pressure natural gas to the at least one fuel conditioning tank thereby to increase the pressure therein.

4. The fueling station according to claim 1, further including means for selectively reducing the pressure in the fuel conditioning tank.

5. The fueling station according to claim 4, wherein said means for selectively reducing the pressure includes means for venting natural gas from the at least one fuel conditioning tank to the means for supplying.

6. The fueling station according to claim 1, wherein the means for saturating includes means for delivering high pressure natural gas to the LNG in the at least one fuel conditioning tank.

7. The fueling station according to claim 1, further including means for delivering LNG and natural gas to the use device and for first delivering natural gas from the vehicle mounted tank to the fueling station if necessary to create a pressure differential to permit refilling.

8. The fueling station according to claim 1, wherein a microprocessor controls the operation of the fueling station.

9. A no loss fueling station for delivery of liquid natural gas (LNG) to a fuel tank of a use device such as a motor vehicle, comprising:

a) a fuel conditioning tank holding a quantity of LNG and a gas head;

b) means for delivering LNG to the fuel conditioning tank;

c) means for pressurizing the LNG in the fuel conditioning tank including a compressor and CNG storage bank for creating and storing compressed natural gas and for delivering the natural gas to the fuel conditioning tank to deliver LNG to the fuel tank;

d) means for controlling the means for creating and storing and the means for pressurizing to maintain a desired pressure and temperature in the fuel conditioning tank without venting natural gas to the atmosphere; and e) means for delivering the LNG from the pressure building means to the fuel tank of the use device.

10. The fueling station according to claim 9, further including means for saturating the LNG in the fuel conditioning tank to prevent collapse of the pressure head in the fuel tank after the LNG is delivered thereto.

11. The fueling station according to claim 9, further including means for reducing the temperature and pressure of the LNG in the fuel conditioning tank.

12. The fueling station according to claim 11, further including means for communicating the gas head in the fuel conditioning tank with the gas head in said storage tank.

13. The fueling station according to claim 11, wherein the means for reducing pressure includes means for venting the natural gas head in the fuel conditioning tank to the storage tank.

14. The fueling station according to claim 9, wherein said delivering means includes a storage tank holding a quantity of LNG greater than that in said fuel conditioning tank and a gas head.

15. A no loss fueling station for delivering liquid natural gas (LNG) to a use device, comprising:

a) at least one fuel conditioning tank holding a supply of LNG and a gas head;

b) means for supplying a quantity of LNG to said at least one fuel conditioning tank including a relatively large volume storage tank;

c) means for saturating the LNG in the at least one fuel conditioning tank including a CNG storage bank for storing compressed natural gas at high pressure and means for delivering the compressed natural gas to the LNG in the at least one fuel conditioning tank;

d) means for pressurizing the LNG in the at least one fuel conditioning tank including means for delivering compressed natural gas from the CNG storage bank to the gas head;

e) means for delivering LNG from the at least one fuel conditioning tank to the use device.

16. The fueling station according to claim 15, further including means for venting natural gas from the at least one fuel conditioning tank to the storage tank.

17. The fueling station according to claim 15, wherein the means for saturating further includes means for delivering LNG from the storage tank to the CNG storage bank including means for vaporizing the LNG.

18. The fueling station according to claim 15, wherein the means for saturating further includes means for delivering natural gas from the storage tank to the CNG storage bank.

19. The fueling station according to claim 15, wherein the compressed natural gas is created by a compressor.

20. The fueling station according to claim 15, wherein the operation of the fueling station is microprocessor controlled.

21. A no loss fueling station for delivery of liquid natural gas (LNG) to a motor vehicle having a tank mounted thereon, comprising:

a) at least one fuel conditioning tank;

b) means for supplying a quantity of LNG to said at least one fuel conditioning tank;

c) means for pressurizing the LNG in at least one fuel conditioning tank including a liquid pump and vaporizer and CNG storage bank for creating and storing compressed natural gas and delivering the compressed natural gas to at least one fuel conditioning tank to obtain a desired minimum pressure thereby to subcool the LNG for efficient delivery to the vehicle mounted tank; and d) means for delivering LNG from at least one fuel conditioning tank to the vehicle mounted tank.

22. The fueling station according to claim 21, further including means for saturating the LNG in the fuel conditioning tank to prevent collapse of the pressure head in the vehicle mounted tank when the LNG is delivered thereto.

23. A no loss fueling station for delivery of liquid natural gas (LNG) to the tank of a motor vehicle, comprising:

a) at least one fuel conditioning tank;

b) means for supplying a quantity of LNG to said at least one fuel conditioning tank;

c) means for pressurizing the LNG in at least one fuel conditioning tank including a source of LNG, means for delivering LNG from the source of LNG to a vaporizer, said vaporizer vaporizing the LNG and pressurizing the vaporized LNG and means for delivering the vaporized LNG to at least one fuel conditioning tank to obtain a desired minimum pressure therein thereby to subcool the LNG for efficient delivery to the vehicle mounted tank; and d) means for delivering LNG from the at least one fuel conditioning tank to the vehicle mounted tank.

24. The fueling station according to claim 23, further including means for saturating the LNG in the fuel conditioning tank to prevent collapse of the pressure head in the vehicle mounted tank when the LNG is delivered thereto.

* * * * *